US006006770A

United States Patent [19]

Lin et al.

[11] Patent Number: 6,006,770

[45] Date of Patent: Dec. 28, 1999

[54] RELIABLY CONTROLLABLE WINDPROOF UMBRELLA

[75] Inventors: Chung-Kuang Lin; Jung-Jen Chang, both of Taipei Hsien, Taiwan

[73] Assignee: Fu Tai Umbrella Works, Ltd., Taipei, Taiwan

[21] Appl. No.: 09/261,861

[22] Filed: Mar. 2, 1999

Related U.S. Application Data

[62] Division of application No. 09/128,723, Aug. 3, 1998.

[51] Int. Cl.[6] ..... A45B 25/26

[52] U.S. Cl. ..... 135/33.7; 135/32; 135/31; 135/29

[58] Field of Search ..... 135/29, 31, 32, 135/33.7, 25.31, 25.32, 40

[56] References Cited

U.S. PATENT DOCUMENTS

| | | | |
|---|---|---|---|
| 212,457 | 2/1879 | Girbardt | 135/33.8 |
| 1,027,426 | 5/1912 | McClellan | 135/32 |
| 3,565,087 | 2/1971 | Arai et al. | 135/32 |
| 3,960,162 | 6/1976 | Noel | 135/33.7 |
| 4,979,534 | 12/1990 | Johnson et al. | 135/33.7 |
| 5,078,166 | 1/1992 | Lee | 135/33.7 |
| 5,115,827 | 5/1992 | Lee | 135/33.7 |
| 5,121,764 | 6/1992 | Wu | 135/32 X |
| 5,247,956 | 9/1993 | Vincent | 135/31 X |
| 5,601,103 | 2/1997 | Dubinsky | 135/33.7 |
| 5,640,984 | 6/1997 | Dubinsky | 135/33.7 |

*Primary Examiner*—Carl D. Friedman
*Assistant Examiner*—Winnie Yip

[57] ABSTRACT

A windproof umbrella includes: an upper cloth secured on an upper rib pivotally connected to a central shaft of the umbrella, a lower cloth secured on a lower rib pivotally connected to the central shaft and having a central opening circumferentially formed in a top portion of the lower cloth around the central shaft, each upper cloth provided with a control valve thereon for resiliently normally closing an aperture between the upper cloth and the lower cloth; and upon blowing of strong wind on the lower and upper cloths, the control valve will be opened to release the wind for preventing inversion of the umbrella.

3 Claims, 5 Drawing Sheets

RELIABLY CONTROLLABLE WINDPROOF UMBRELLA

This is a divisional continuation of co-pending application control Ser. No. 09/128,723 filed Aug. 3, 1998.

BACKGROUND OF THE INVENTION

U.S. Pat. No. 4,979,534 to Johnson et al. disclosed a windproof umbrella having a lower canopy with vent holes and an upper canopy in covering relation to the vent holes to provide air escape during high winds so as to prevent inversion of the umbrella.

Johnson's prior art is illustrated in FIG. 11, in which the upper canopy (36) is resiliently secured to the tips (28) by elastic straps (48), and the lower canopy (20) is secured on the ribs (18) which are pivotally connected with the struts (16) at points (P) and the runner held on the shaft. Upon wind (W) blowing through the vent holes 34, the air will escape through the aperture between the upper canopy (36) and the lower canopy (20) by forcibly stretching the elastic straps (48). Since the lower (outer) end portion of each strap (48) is distantly separated from the pivotal connection point (P), a great arm of force as effected by strong or high winds will exert a great moment acting upon the pivotal connection points (P) to cause breaking from such points (P), thereby easily breaking and damaging the ribs of the umbrella of the prior art.

The present inventor has found the drawbacks of the conventional windproof umbrella and invented the present windproof umbrella which can be reliably controlled.

SUMMARY OF THE INVENTION

The object of the present invention is to provide a windproof umbrella including: an upper cloth secured on an upper rib pivotally connected to a central shaft of the umbrella, a lower cloth secured on a lower rib pivotally connected to the central shaft and having a central opening circumferentially formed in a top portion of the lower cloth around the central shaft, each upper cloth provided with a control valve thereon for resiliently normally closing an aperture between the upper cloth and the lower cloth; and upon blowing of strong wind on the lower and upper cloths, the control valve will be opened to release the wind for preventing inversion of the umbrella.

DETAILED DESCRIPTION

Figures 1, 2, 3:
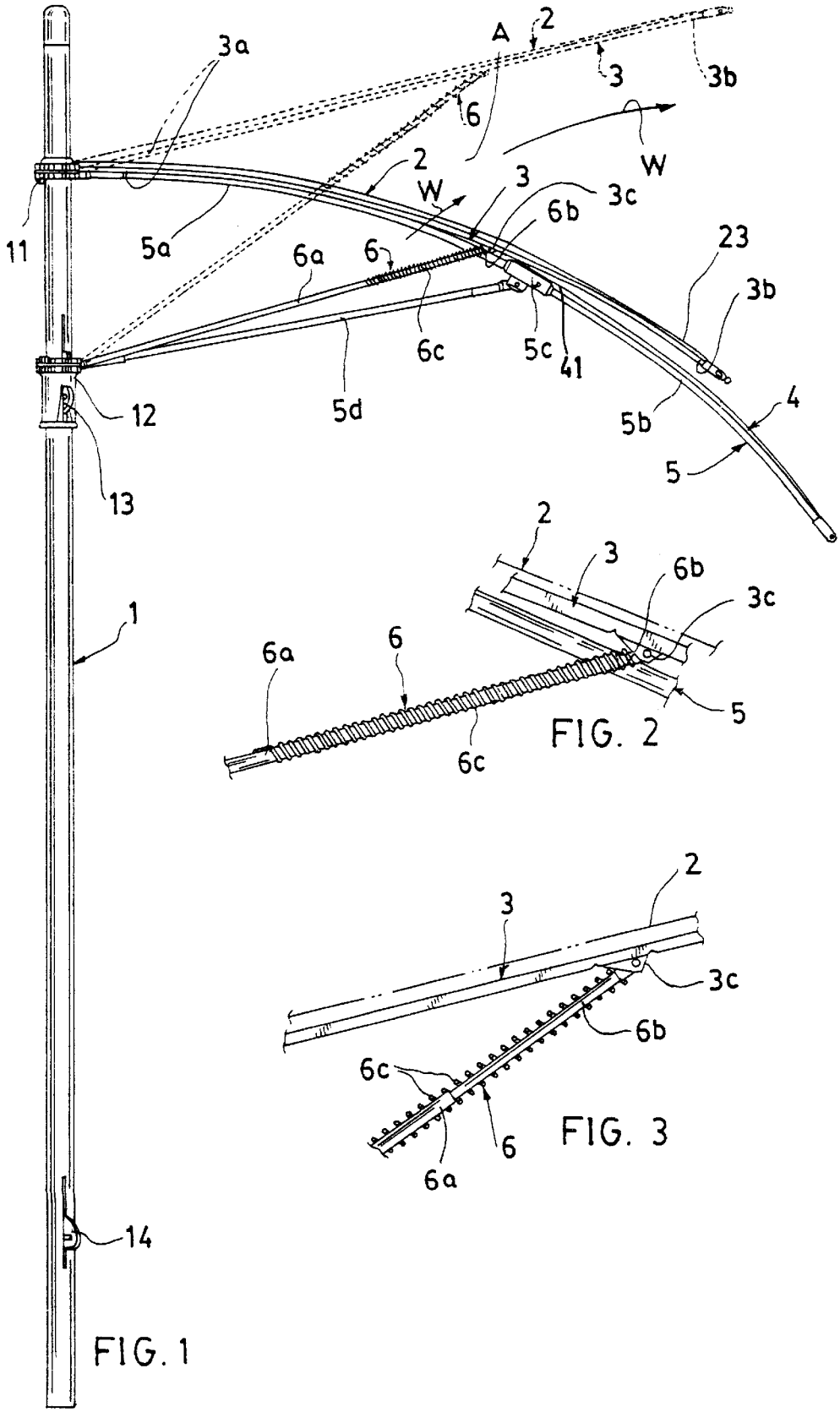
FIG. 1 shows an opening umbrella of the present invention.
FIG. 2 shows a closed control valve of FIG. 1.
FIG. 3 shows an opened control valve of FIG. 1.
Figure 5:
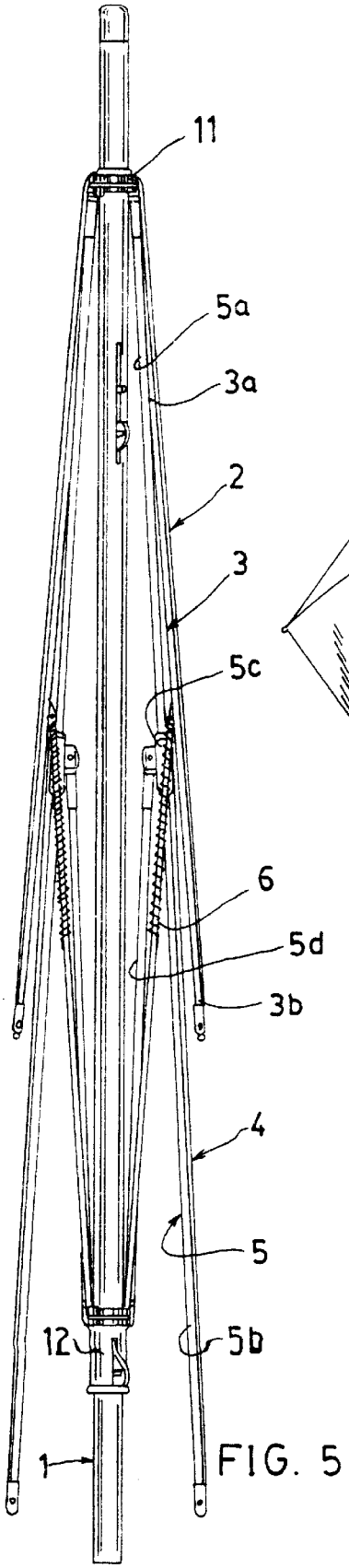
FIG. 5 shows a folded umbrella from FIG. 1.
Figure 4:
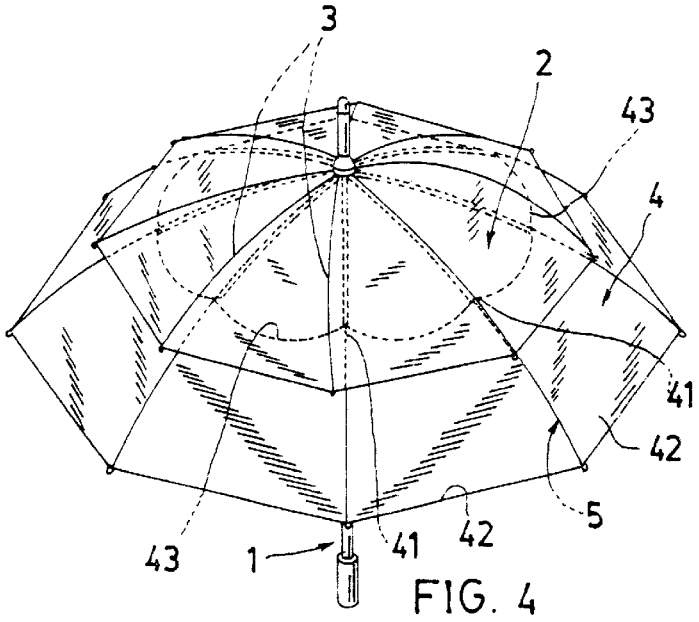
FIG. 4 is a perspective view of the present invention of FIG. 1.

As shown in FIGS. 1–5, the present invention comprises: an upper cloth 2 secured on an upper rib 3 having an inner rib portion 3*a* pivotally secured to the upper notch 11 on the central shaft 1 having an upper catch 13 and a lower catch 14, a lower cloth 4 secured on a lower rib 5 having an inner rib portion 5*a* pivotally secured to the upper notch 11, with the lower rib 5 positioned under and juxtapositioned to the upper rib 3. The outer rib portion 3*b* having an outer flap portion 23 of the upper cloth 2 secured thereon is protruded outwardly beyond a central opening 43 of the lower cloth 4 to allow the upper cloth 2 to close the central opening 43 of the lower cloth 4 formed on a top of the lower cloth 4.

Each upper rib 3 has a middle lug 3*c* between the inner rib portion 3*a* and an outer rib portion 3*b* for pivotally connecting a control valve 6 which includes: a linking member 6*b* pivotally connected with the middle lug 3*c* of the upper rib 3, a stretcher rib portion 6*a* having its inner end pivotally connected with the lower runner 12 and having an outer end of the stretcher rib portion 6*a* telescopically engageable with the linking member 6*b*, and a restoring spring 6*c* resiliently connecting the stretcher rib portion 6*a* and the linking member 6*b* for normally retracting the linking member 6*b* into the stretcher rib portion 6*a* for approximating the upper rib 3 to the lower rib 5 for closing the upper cloth 2 on the lower cloth 4 for closing the aperture between the upper and lower cloths 2, 4.

Each lower rib 5 has a middle lug 5*c* formed between an inner rib portion 5*a* and an outer rib portion 5*b* for pivotally connecting a stretcher rib portion 5*d* which is pivotally secured to the lower runner 12.

Upon blowing of strong wind W to upwardly pull the upper cloth 2, the upper rib 3 and the linking member 6*b* from the stretcher rib portion 6*a*, the aperture A between the upper cloth 2 and the lower cloth 4 will be opened as shown in FIG. 3 and in dotted line of FIG. 1 to release the air from the aperture A to prevent inversion of the umbrella.

When the wind is gone, the restoring spring 6*c* of the control valve 6 will restore the linking member 6*b* to be retracted into the stretcher rib portion 6*a* to close the upper cloth 2 to the lower cloth 4 for closing the aperture A between the two cloths 2, 4.

The stretcher rib portion 6*a* may be formed as an outer tube to telescopically receive the linking member 6*b* which may be made as an inner tube.

The inner tip portion 41 (opposite to an outer portion 42) of the lower cloth 4 is secured on the middle lug 5*c* of the lower rib 5.

Figures 6, 7, 8:
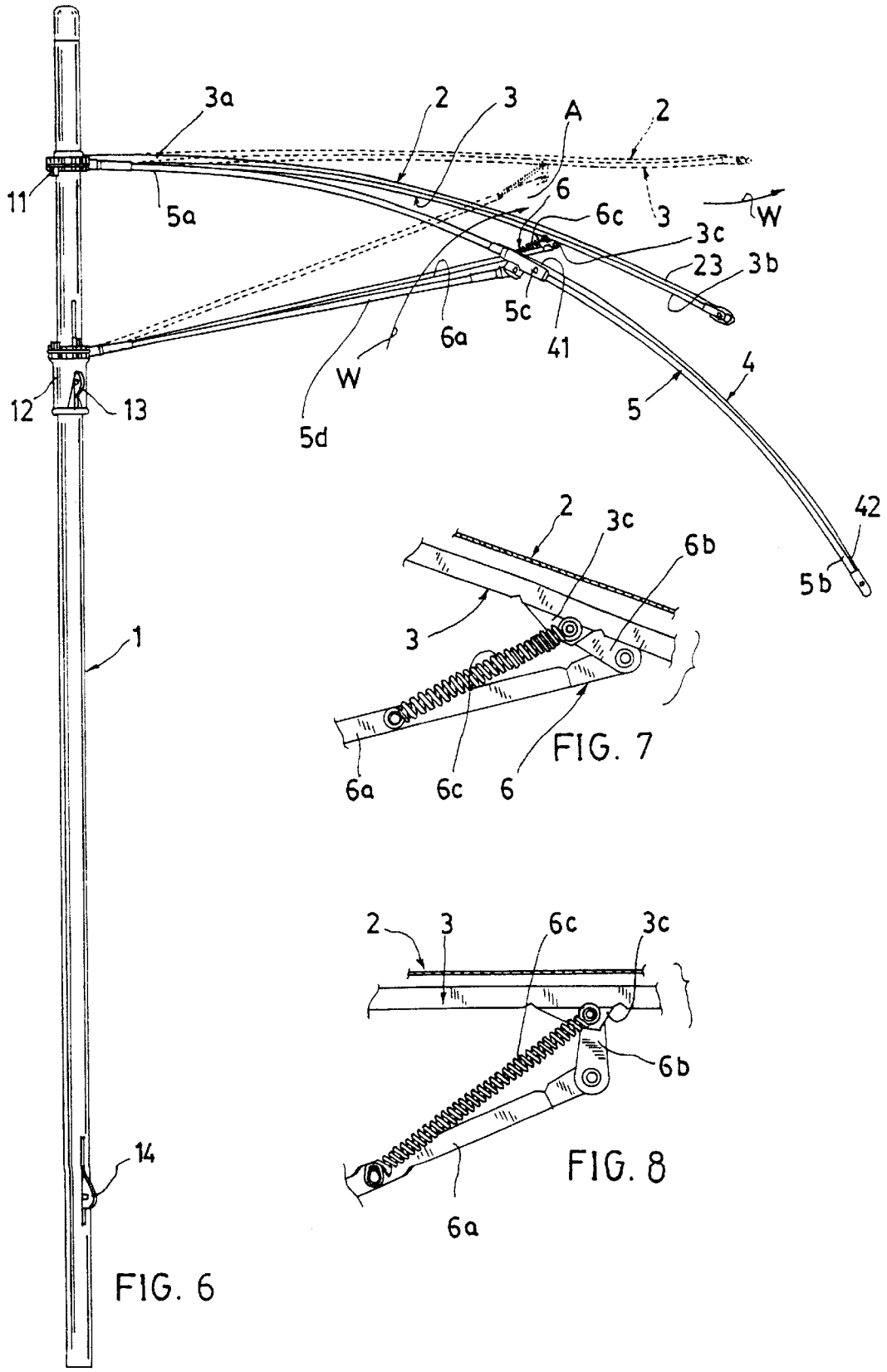
FIG. 6 shows another preferred embodiment of the present invention when opened.
FIG. 7 shows a closed control valve of FIG. 6.
FIG. 8 shows an opened control valve of FIG. 6.
Figure 10:
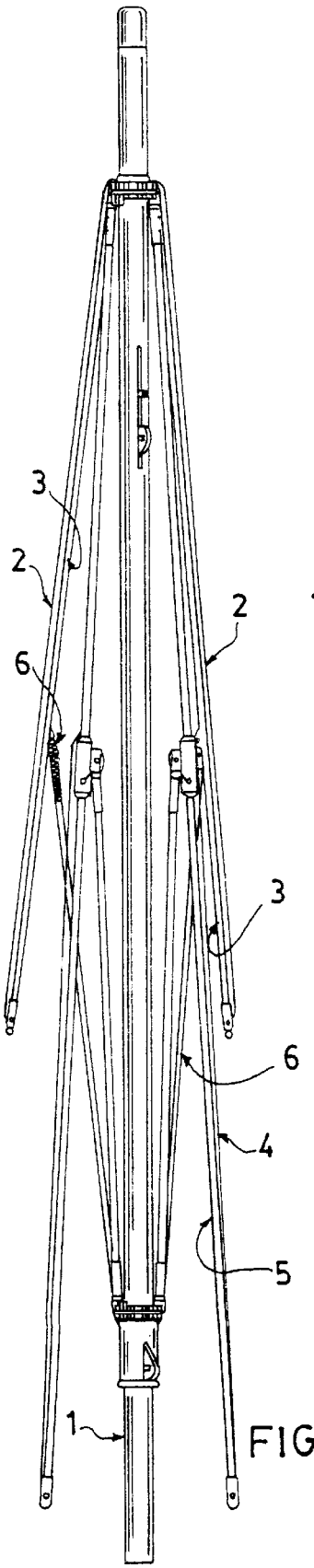
FIG. 10 shows a folded umbrella from FIG. 6.

As shown in FIGS. 6–10, another preferred embodiment of the present invention is made as derived from the embodiment of FIGS. 1–3 by modifying the control valve 6 as shown in FIGS. 2, 3 to include: a stretcher rib portion 6*a* pivotally secured to the lower runner 12, a linking member 6*b* pivotally secured between the stretcher rib portion 6*a* and a middle lug 3*c* of the upper rib 3, and a restoring spring 6*c* resiliently connecting the linking member 6*b* with the stretcher rib portion for normally tensioning the linking member 6*b* to the stretcher rib portion 6*a* for closing the upper cloth 2 to the lower cloth 4 as shown in FIGS. 7, 6.

Upon wind blowing to pull the upper cloth 2 upwardly to extend the linking member 6*b* from the stretcher rib portion 6*a* (FIGS. 8, 6), the control valve 6 is opened to allow air escaping from the aperture A between the upper and lower cloths 2, 4. Afterwards, the restoring spring 6*c* will restore the linking member 6*b* towards the stretcher rib portion 6*a* as shown in FIGS. 7 and 6 to close the upper and lower cloths 2, 4.

Figure 9:
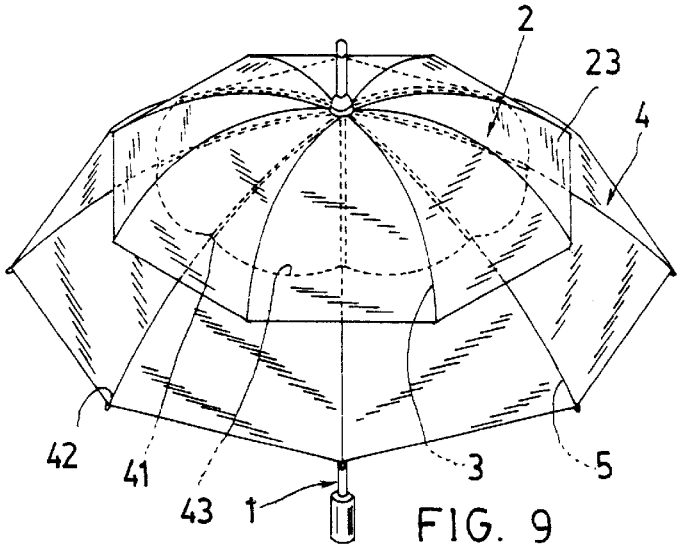
FIG. 9 is a perspective view of the present invention as shown in FIG. 6.
Figure 11:
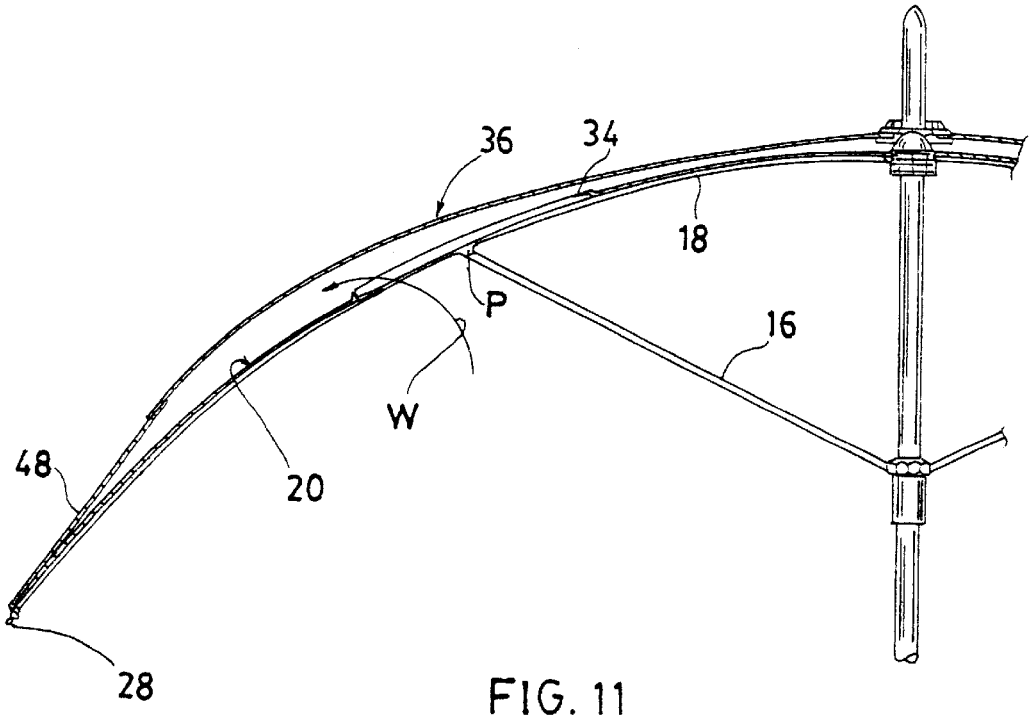
FIG. 11 PRIOR ART
FIG. 11 shows a prior art of a conventional windproof umbrella.

As shown in FIG. 9, the upper rib 3 may be projectively angularly deviated from the lower rib 5 for forming a different design and decoration if plural colors are respectively formed on the "sectors" of the umbrella cloths 2, 4. Each ball tip (not shown) at the outer end of each upper rib 3 may be well clad by the upper cloth 2 to prevent pricking damage to the lower cloth 4.

The present invention may be further modified without departing from the spirit and scope of the present invention.

For instance, the umbrella ribs 3, 5 may be provided for multiple-fold umbrella, while the central shaft 1 may be consisting of a plurality of tubes telescopically engageable with one another.

The "control valve" 6 as designated in the present invention is defined to express its control mechanism for opening or closing the aperture A between the upper cloth 2 and the lower cloth 4, like a "control valve" for opening or closing a water or air streamflow in fluid mechanics.

I claim:

1. A windproof umbrella comprising: a central shaft; an upper cloth secured on at least an upper rib pivotally secured to the central shaft; a lower cloth secured on at least a lower rib pivotally secured to the central shaft, with the lower rib positioned under and juxtapositioned to the upper rib, said upper rib having an outer rib portion secured thereon with an outer flap portion of the upper cloth, sad outer rib portion of said upper rib protruded outwardly beyond a central opening formed on a top of said lower cloth to allow the upper cloth to close the central opening of the lower cloth by a control valve connected with said upper rib; said control valve operatively opened by a strong wind to release air from an aperture between said upper and lower cloths; each said upper rib having a middle lug between an inner rib portion and the outer rib portion of said upper rib for pivotally connecting said control valve on said middle lug, said control valve including: a linking member pivotally connected with the middle lug of the upper rib, a stretcher rib portion having an inner end thereof pivotally connected with a lower runner slidably held on the shaft and having an outer end of the stretcher rib portion telescopically engaging with the linking member, and a restoring spring resiliently connecting the stretcher rib portion and the linking member for normally retracting the linking member into the stretcher rib portion for approximating the upper rib to the lower rib for closing the upper cloth on the lower cloth for closing the aperture between the upper and lower cloths.

2. A windproof umbrella according to claim 1, wherein each said lower rib is projectively angularly deviated from each said upper rib.

3. A windproof umbrella comprising: a central shaft; an upper cloth secured on at least an upper rib pivotally secured to the central shaft; a lower cloth secured on at least a lower rib pivotally secured to the central shaft, with the lower rib positioned under and juxtapositioned to the upper rib, said upper rib having an outer rib portion secured thereon with an outer flap portion of the upper cloth, sad outer rib portion of said upper rib protruded outwardly beyond a central opening formed on a top of said lower cloth to allow the upper cloth to close the central opening of the lower cloth by a control valve connected with said upper rib; said control valve operatively opened by a strong wind to release air from an aperture between said upper and lower cloths; and said control valve including: a stretcher rib portion pivotally secured to a lower runner held on the shaft, a linking member pivotally secured between the stretcher rib portion and a middle lug of the upper rib, and a restoring spring resiliently connecting the linking member with the stretcher rib portion for normally tensioning the linking member to the stretcher rib portion for closing the upper cloth to the lower cloth.

* * * * *